73-151 SR
3/29/88 XR 4,734,860

United States Patent [19]
Egli et al.

[11] Patent Number: 4,734,860
[45] Date of Patent: Mar. 29, 1988

[54] SIMPLIFIED BORE HOLE SURVEYING SYSTEM BY KINEMATIC NAVIGATION WITHOUT GYROS

[75] Inventors: Werner H. Egli, Minneapolis; Lawrence C. Vallot, Shoreview, both of Minn.

[73] Assignee: Honeywell, Inc., Minneapolis, Minn.

[21] Appl. No.: 831,983

[22] Filed: Feb. 21, 1986

[51] Int. Cl.[4] ..... E21B 47/022
[52] U.S. Cl. ..... 364/422; 33/313; 73/151
[58] Field of Search ..... 33/302, 304, 313; 175/45; 364/559; 73/151; 364/422

[56] References Cited

U.S. PATENT DOCUMENTS

| | | | |
|---|---|---|---|
| 3,279,086 | 8/1963 | Schlitt et al. | 33/324 |
| 3,463,909 | 8/1969 | Weiss | 364/559 |
| 3,611,581 | 10/1971 | Butler et al. | 33/313 |
| 3,753,296 | 8/1973 | Van Steenwyk | 33/304 |
| 3,791,043 | 2/1974 | Russell | 33/312 |
| 3,805,398 | 4/1974 | Russell et al. | 33/312 |
| 3,808,697 | 5/1974 | Hall | 33/312 |
| 3,862,499 | 1/1975 | Isham et al. | 33/312 |
| 3,935,642 | 2/1976 | Russell | 33/302 |
| 4,192,077 | 3/1980 | Van Steenwyk et al. | 33/313 |
| 4,197,654 | 4/1980 | Van Steenwyk et al. | 33/304 |
| 4,199,869 | 4/1980 | Van Steenwyk | 33/302 |
| 4,231,252 | 11/1980 | Cherkson | 73/151 |
| 4,238,889 | 12/1980 | Barriac | 33/304 |
| 4,244,116 | 1/1981 | Barriac | 33/304 |
| 4,265,028 | 5/1981 | Van Steenwyk | 33/304 |
| 4,293,046 | 10/1981 | Van Steenwyk | 175/45 |
| 4,344,235 | 8/1982 | Flanders | 33/366 |
| 4,399,692 | 8/1983 | Hulsing, II et al. | 33/313 X |
| 4,459,759 | 7/1984 | Hulsing, II | 33/304 |
| 4,471,533 | 9/1984 | Van Steenwyk et al. | 33/302 |
| 4,559,713 | 12/1985 | Ott et al. | 33/302 |

FOREIGN PATENT DOCUMENTS

| | | | |
|---|---|---|---|
| 0972556 | 8/1975 | Canada | 33/313 |

*Primary Examiner*—Jerry Smith
*Assistant Examiner*—Clark A. Jablon
*Attorney, Agent, or Firm*—Merchant, Gould, Smith, Edell, Welter & Schmidt

[57] ABSTRACT

Apparatus and method for the surveying of bore holes, for example, oil wells and the like, to permit accurate three-dimensional mapping thereof, using an accelerometer package in an instrumentation pod which is lowered into the bore hole. In one embodiment the pod is lowered on the end of a rod string where adjacent rods connected together with Hookes-joint pivots which permit two degrees of freedom of movement between adjacent rods. In another embodiment, rigid interconnections of adjacent rods are used, and the rods are isotropic for twistless flexure as the rods encounter curves in the path of the bore hole. The instrumentation pod is lowered one rod-length at a time, and accelerometer readings are taken which, together with mathematical modeling of rod motion, permits calculation of updated pod position at all depths in the hole.

9 Claims, 6 Drawing Figures

SIMPLIFIED BORE HOLE SURVEYING SYSTEM BY KINEMATIC NAVIGATION WITHOUT GYROS

FIELD OF THE INVENTION

This invention pertains to the field of apparatus and methods for the surveying of bore holes, for example, oil well bore holes, to permit determination and mapping of the exact location of the hole at all levels.

BACKGROUND OF THE PRIOR ART

It is often necessary to survey a bore hole in the earth to determine the exact path or location of the hole at all levels. For example, in the fields of oil and gas drilling and geological testing, it is necessary to correlate formations found at different depths in the bore hole, and to do so it is also necessary to know the spatial coordinates of all points along the bore hole. Since the drill bit typically wanders from a straight vertical path during the drilling of the hole, for bore holes of any appreciable depth the location cannot be predicted without specialized survey apparatus.

Numerous systems have been used in the prior art for providing survey data for bore holes. Generally, an instrumented pod is lowered into the bore hole and readings are taken by instruments within the pod and transmitted by wire or otherwise to the surface. Various types of inclinometers or accelerometers, gyroscopes, magnetic sensors and the like have been used to attempt to measure the inclination and direction, or azimuth, of the bore hole at different levels, so that a map may be made for the bore hole. While such systems have achieved a degree of success, in many cases problems with accuracy, cost of manufacture, and slow, time-consuming operation remain. For example, magnetic sensors, which are used in numerous systems for sensing the direction of the Earth's magnetic field within the bore hole to thereby provide a north reference, are inherently subject to potential errors in this environment. Iron-bearing geologic formations at different depths can cause erroneous readings, and of course the instrument cannot be used in the vicinity of ferrous casings, shafts, or other tools, thus creating special application problems. Accelerometers are potentially accurate and reliable devices, but alone cannot fully determine the spatial location and orientation of the instrument pod. Free directional gyroscopes and gyroscopes having multiple sensing axes have been used, but these are complex and costly, and in some cases have drift or precession problems which must be corrected for. Rate gyroscopes can be somewhat smaller and more reliable, but in the past they have been used together with motors and drive apparatus for rotating the rate gyroscope to thereby serve as a north direction finder. Such drive motors and apparatus add cost and complexity and take up valuable space within the instrument pod.

In our co-pending patent application Ser. No. 831,982 filed Feb. 21, 1986, entitled "Oil Well Bore Hole Surveying by Kinematic Navigation", we describe a system using a rate gyroscope, two or three accelerometers, and computation techniques for determining pod attitude and position as it is lowered into the bore hole. While this system can provide accurate surveys, it is recognized that it might be advantageous under some circumstances to provide a survey system without the rate gyroscope, which would eliminate the cost and space requirement of the gyro, and would simplify the system by eliminating the need for sensing and correcting for Earth rate.

SUMMARY OF THE INVENTION

Accordingly, the present invention provides simplified systems for bore hole surveying which overcome the problems existing in the field referred to above, which eliminate the need for a gyro and which are relatively simple to make and use while providing accurate and reliable results.

The present invention provides bore hole survey apparatus which includes an instrument carrier or pod adapted to be lowered down into a bore hole to be surveyed. The pod is attached to, or formed integral with, a rod, and a plurality of additional rods are provided for connection end-to-end to form a rod string as the instrument pod is lowered into the bore hole. The pod includes a triad of accelerometers whose readings measure the gravity vector, that is, the local vertical as seen in the reference frame of the accelerometers. This information, plus constraints on the flexure of the rods or inter-rod connections, defines and permits measurement of the attitude of the pod and permits calculation and updating of pod position as each new rod length is added.

According to one embodiment of the invention, the one degree of constraint on the flexure of the inter-rod connections is provided by special Hookes-joint connections for the rods. As rods are added to the rod string, each is attached to the next by a Hookes-joint pivot which permits two degrees of freedom of movement between adjacent rods, but which removes one degree of freedom, i.e., prevents "twisting" between rods and preserves the known angular rotational position of the lead rod. Removal of this one degree of freedom enables a kinematic navigation solution using the accelerometer readings which are taken as each new rod is connected.

According to another embodiment, rods are used which fit rigidly together, for example by screwing together. The rods are isotropic so that no twist is imparted as the rod flexes. As the rod string is lowered into the bore hole rod-length by rod-length, any rod flexure for each rod is assumed to be around an axis perpendicular to the rod length without any twist component. This one degree of constraint plus the accelerometer readings from the lead rod instrument pod enables the kinematic navigation solution of the pod, permitting updating of pod position at all depths to thereby give a three-dimensional survey of the bore hole.

The calculations can be performed by computational means either at the surface or partially or wholly on the pod, to take the accelerometer readings for each rod length added, and for calculating and updating pod position as it is progressively lowered into the bore hole. The calculated position can be printed, displayed or stored, as may be desired.

DETAILED DESCRIPTION OF THE PREFERRED EMBODIMENTS

Figure 1:
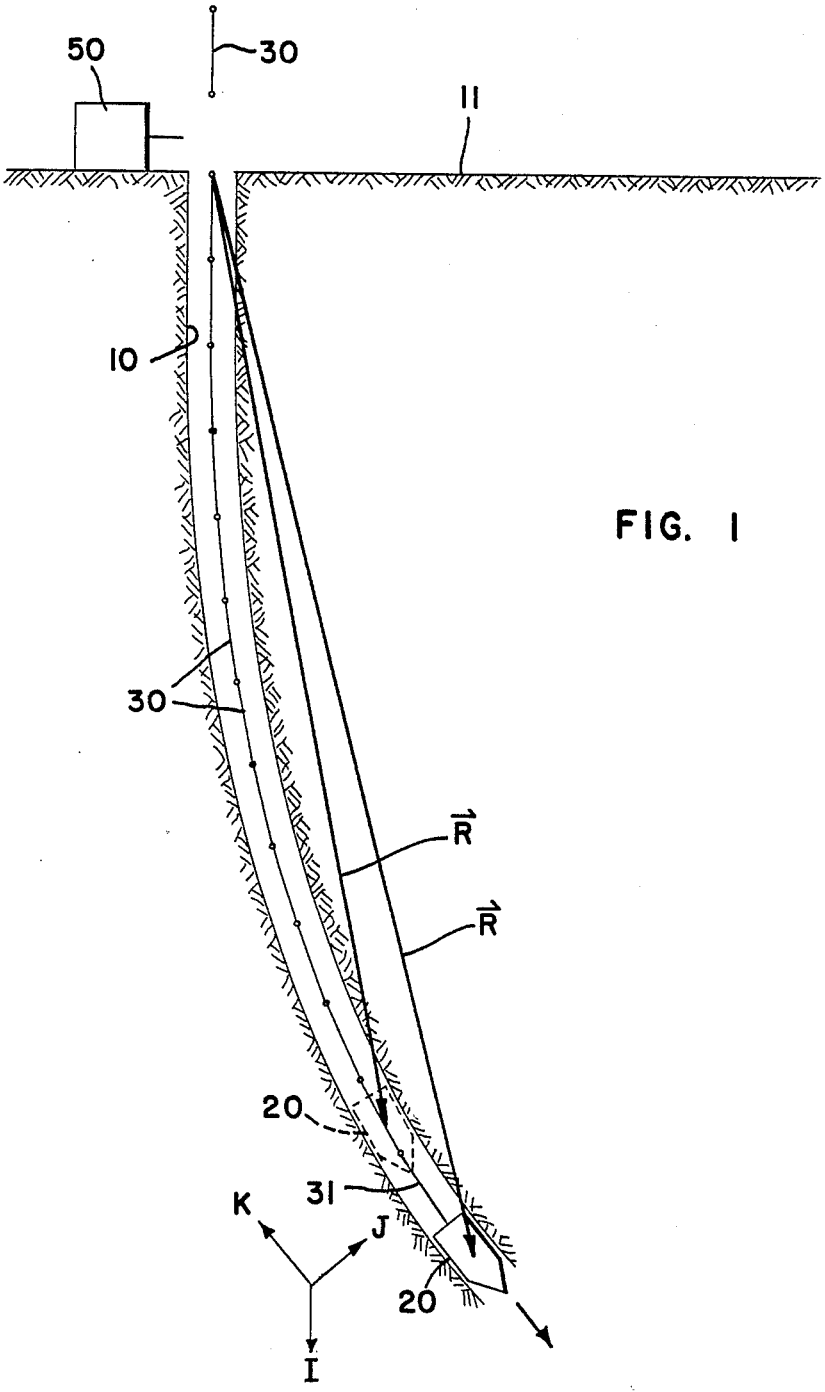
FIG. 1 is a schematic representation of an instrument pod being lowered into a bore hole to be surveyed.

In FIG. 1, a bore hole 10 is shown in crosssectional view extending from the surface 11 some distance into the ground. Bore hole 10 is indicated as being curved since, as pointed out above, the direction of the bore hole in general may wander erratically as the hole is being drilled, and the exact path is not known until it is surveyed. Although a single gentle curve of bore hole 10 is indicated in FIG. 1, it will be appreciated that this is for illustrative purposes only, and in fact bore holes may, and generally do, have multiple changes of direction, so that in general the bore hole can veer in any direction at any depth.

An instrument pod 20 according to the present invention is shown lowered into the bore hole, being suspended by a string of interconnected rods 30. The rods have a length l and have attachment means at each end so that they can be connected together to form the rod string. The lead rod 31 is attached to instrument pod 20. Alternatively, instrument pod 20 can be formed integrally with lead rod 31. The pod is lowered into the bore hole by attaching an additional rod 30 at the surface, lowering the rod string by the distance l, and repeating the process.

Reference number 50 in FIG. 1 symbolically represents computational apparatus which is used in conjunction with the invention, as hereinafter explained, for calculating of pod position, and storage and optional display pod position as it is lowered into the hole being surveyed. Accelerometer readings are taken for each rod-length of lowering, and microcomputer processing equipment uses the accelerometer readings to provide rod end attitude and location updates. Computation apparatus 50 receives data from pod 20 by suitable wire transmissions (not shown) or other known telemetry techniques.

Also shown in FIG. 1 are mutually perpendicular coordinate vectors I, J and K, which are the body axes for the instrument pod 20. $\vec{k}$ is unit vector along the lead rod 31, and $\vec{R}$ is the position vector from the start of the bore hole to the current position of pod 20. As indicated in FIG. 1, the position vector $\vec{R}$ is updated for each rod length added by the algorithm $\vec{R}=\vec{R}-\vec{k}l$.

Figure 2:
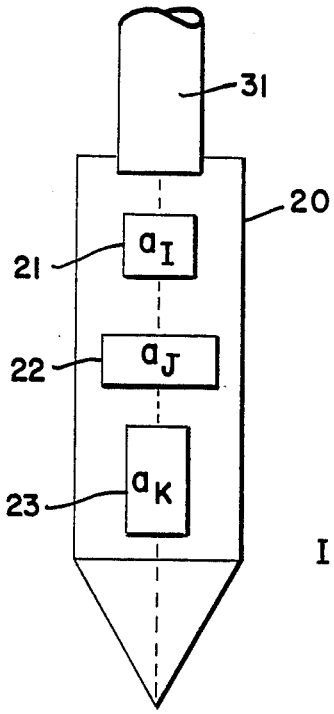
FIG. 2 is a diagram showing the orientation of sensing components within the instrument pod.
Figure 3:
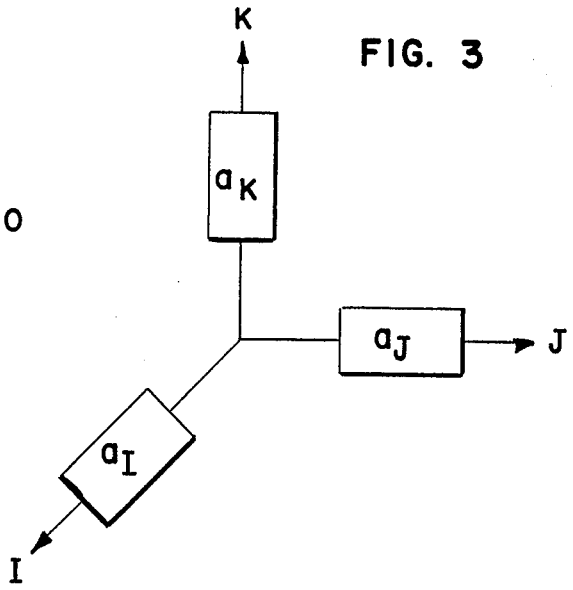
FIG. 3 is a diagram illustrating the alignment of the accelerometer sensed axes with the coordinate system used for calculation.

Referring to FIGS. 2 and 3, instrument pod 20 is shown attached to the end of the lead rod 31. Instrument pod 20 is shown schematically to include three accelerometers 21, 22 and 23. Accelerometer 21 is labeled $a_I$ and its sensitive axis is aligned with, and defines the I axis of the lead rod and pod. Accelerometer 22 is labeled $a_J$ and its sensitive axis is aligned with, and defines, the J body axis. Similarly, accelerometer 23 is labeled $a_K$, and has its sensitive axis along the K body axis, which is the longitudinal axis of the pod, along which it is presumed to travel in the bore hole. Accelerometers are well known in the art, and for this reason details of their construction and the techniques of mounting them in a body are not shown. Also, techniques for providing power to accelerometers and for transmitting output signals therefrom to computational equipment either on board or at the surface by a wire or other telemetry techniques are known to those skilled in the art and are not set forth in detail here.

It will be appreciated that while the accelerometers 21, 22 and 23 are indicated as being in the pod and the computational equipment 50 as being at the surface, all or a part of the computational equipment can be built into instrument pod 20 through the use of microcircuits and microcomputers as are generally known in the art and in accordance with the principles set forth herein.

Figure 4:
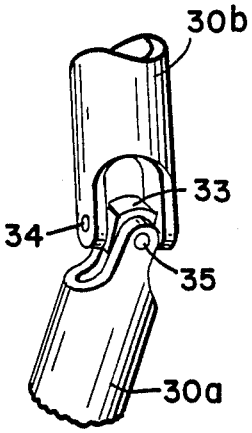
FIG. 4 is a fragmentary view of the Hookes-joint pivot attachment of two rods.

Referring to FIG. 4, an end 30*a* of one rod and an end 30*b* of an adjoining rod are shown attached as a Hookes-joint pivot. Specifically, the rod ends are machined to join together with the Hookes-joint intermember 33, and a pair of pivots 34 and 35. Each rod coordinate frame is defined in terms of I, J and K body axes, with the K-axis upward along the rod length. Thus, each rod has its upper end Hookes-joint attachment as a J-axis pivot, and its lower end Hookes-joint attachment as an I-axis pivot. Consequently, the rotation of each rod relative to its predecessor is compound. First there is rotation of the Hookes-joint intermember 33 relative to the upper rod 30*b*, around the I-axis. Then, the lower rod 30*a* is rotated relative to the Hookes-joint intermember 33 by some amount around the new J-axis. Thus, the lower rod is rotated relative to its predecessor rod by an I-axis body rotation, followed by a J-axis body rotation. The machined ends and the Hookes-joint connectors preserve the 90° relationship between the pivot axes at the two ends of the rod.

Therefore, the rotation matrix, m, by which the lead rod is rotated relative to the rod behind it (i.e., relative to its own previous position at the last preceding update), is described by:

$$m=\begin{bmatrix}1 & 0 & 0\\ 0 & \cos\alpha & -\sin\alpha\\ 0 & \sin\alpha & \cos\alpha\end{bmatrix}\begin{bmatrix}\cos\beta & 0 & \sin\beta\\ 0 & 1 & 0\\ -\sin\beta & 0 & \cos\beta\end{bmatrix}$$

$$=\begin{bmatrix}\cos\beta & 0 & \sin\beta\\ \sin\alpha\sin\beta & \cos\alpha & -\sin\alpha\cos\beta\\ -\sin\beta\cos\alpha & \sin\alpha & \cos\alpha\cos\beta\end{bmatrix},$$

where $\alpha$=I-axis angle of rotation $\beta$=J-axis angle of rotation

The rotation m updates the attitude matrix, M, of the lead rod:

$$M=mM$$

Let the gravity vector be seen as:

$$\hat{k}_2=a_2I+b_2J+c_2K,$$

in the current lead-rod attitude, and as:

$$\hat{k}_1=a_1I+b_1J+c_1K,$$

in the preceding lead-rod attitude, where a, b, c are readings of accelerometers 21, 22, 23. Then by definition:

$$\hat{k}_2=\overline{m}\hat{k}_1,$$

where overbars denote transpose. This leads to the three equations:

$$a_2=a_1 \cos \beta+b_1 \sin \alpha \sin \beta-c_1 \cos \alpha \sin \beta$$

$$b_2=b_1 \cos \alpha+c_1 \sin \alpha$$

$$c_2=a_1 \sin \beta-b_1 \sin \alpha \cos \beta+c_1 \cos \alpha \cos \beta$$

Of the solution set, we require those which give small values of $\alpha$ and $\beta$ i.e., cos $\alpha$ and cos $\beta$ as large as possible. These are:

$$\sin\alpha = \frac{b_2c_1^2 - b_1R_1}{c_1(1 - a_1^2)}$$

$$\cos\alpha = (b_1b_2 + R_1)/(1 - a_1^2)$$

where:

$$R_1 = \sqrt{C_1^2(1 - a_1^2 - b_2^2)}$$

$$\sin\beta = \frac{a_1c_2^2 - a_2R_2}{c_2(1 - b_2^2)}$$

$$\cos\beta = (a_1a_2 + R_2)/(1 - b_2^2)$$

where:

$$R_2 = \sqrt{C_2^2(1 - a_1^2 - b_2^2)}$$

These solutions are then combined to form m, and the end-rod-attitude matrix is updated by:

$$M=mM$$

Ideally, with zero computing noise, the third row of M should exactly equal the gravity vector, as seen in the accelerometers. If not, we can "square up" M at each update, to make this so, and also keep M orthonormal, as follows:

First, we make $\overline{M}_3=\hat{k}$, where $\hat{k}$ is the unit gravity vector as seen in the I, J, K body-axes system:

$$\begin{bmatrix} \overline{M}_1 \longrightarrow \\ \overline{M}_2 \longrightarrow \\ \overline{M}_3 \longrightarrow \end{bmatrix} \longrightarrow \begin{bmatrix} \overline{M}_1 \longrightarrow \\ \overline{M}_2 \longrightarrow \\ k \longrightarrow \end{bmatrix}$$

Next we subtract from $\overline{M}_1$ and $\overline{M}_2$ any component along $\overline{M}_3$:

$$\overline{M}_1=\overline{M}_1-\hat{k}(M_1\cdot\hat{k})$$

$$\overline{M}_2=\overline{M}_2-\hat{k}(M_2\cdot\hat{k})$$

Then, we normalize $\overline{M}_1$ and $\overline{M}_2$ to unit magnitude:

$$\overline{M}_1 = \overline{M}_1/\sqrt{M_1^2}$$

$$\overline{M}_2 = \overline{M}_2/\sqrt{M_2^2}$$

Next, $\overline{M}_1$ and $\overline{M}_2$ are "squared up" relative to each other:

$$\overline{M}_1=\overline{M}_{ave}+A\Delta\overline{M}$$

$$\overline{M}_2=\overline{M}_{ave}-A\Delta\overline{M}$$

where:

$$\overline{M}_{ave}=(\overline{M}_1+\overline{M}_2)/2$$

$$\Delta\overline{M}=(\overline{M}_1-\overline{M}_2)/2$$

$$A=|\overline{M}_1+\overline{M}_2|/|\overline{M}_1-\overline{M}_2|$$

Finally, $\overline{M}_1$ and $\overline{M}_2$ are renormalized to unit magnitude. Having the new value of M, the navigation update is simply:

$$\vec{R}=\vec{R}-\vec{k}l$$

where:

$\vec{R}$ = Position vector
$l$ = Rod length
$\vec{k}$ = Unit vector along lead-rod
= $M_3$ (third column of lead-rod attitude matrix)

Of course, the computations are done in real-time on-line, using a microcomputer to process each new set of accelerometer readings, at each rod addition.

The only limitation on this technique is the chance of a solution error, if either a or b becomes equal to 1.0. For this to happen, either the I or the J rod axis must be vertical. That is, the bore hole must become horizontal, and one of the two Hookes pivot axes must be vertical, too. Even if this rare event did occur, the computation could "bridge over" the singularity, causing some modest added error.

Figure 5:
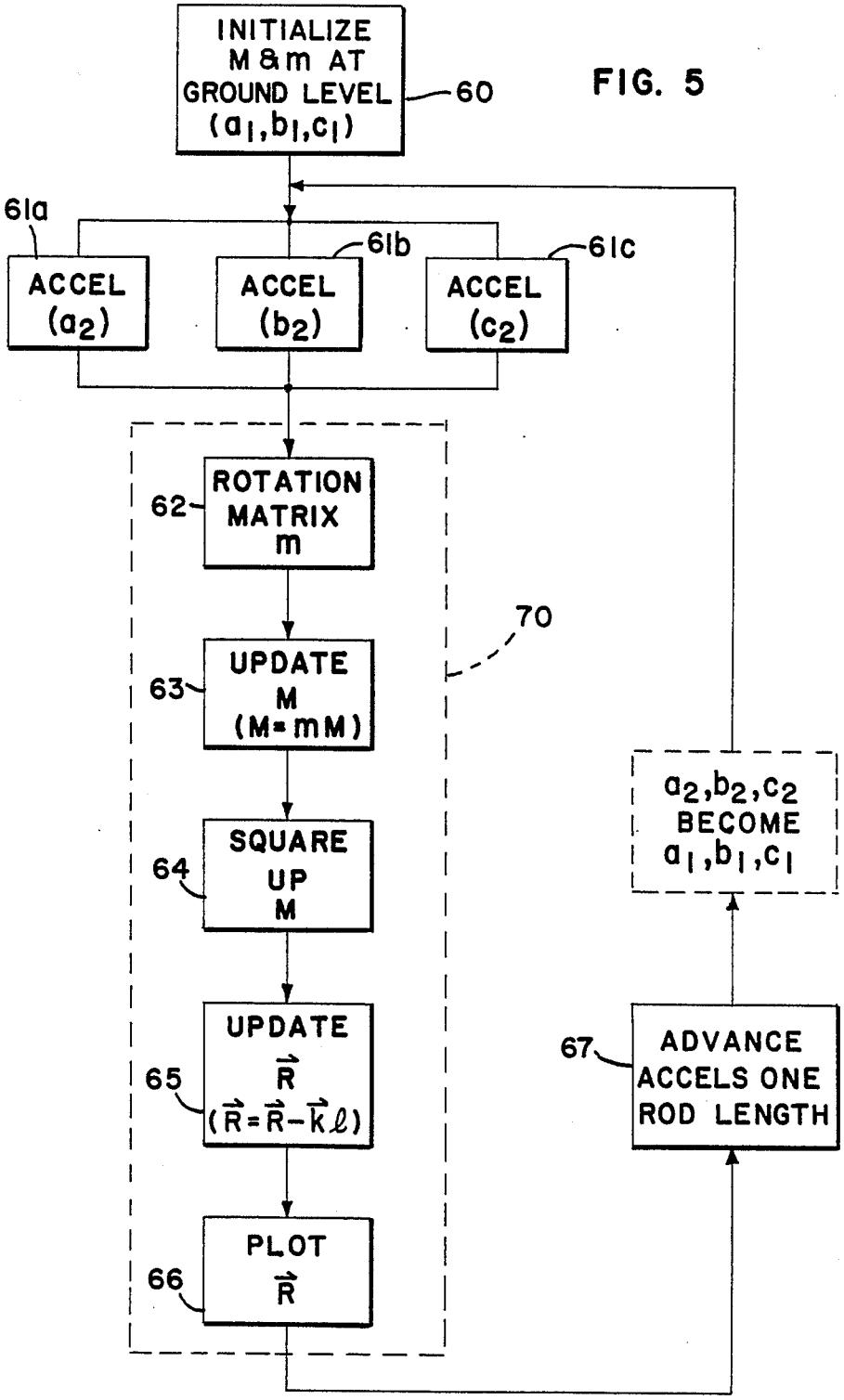
FIG. 5 is a diagram indicating the sequence of operations of the bore hole survey apparatus according to one embodiment of the present invention.

The process is summarized in FIG. 5. At step 60, the orientation of the pod at ground level is selected and M and m are initialized. For convenience, the coordinate system of the pod can be aligned with surface north and east. At steps 61*a*, 61*b* and 61*c*, the three accelerometers 21, 22 and 23 are read, and the results are used in the rotation matrix m at step 62. At step 63, M is updated, and at step 64 M is "squared up". Then, at step 65, the position vector R can be updated, and the position can be plotted and stored at step 66. This display could be as XYZ coordinates, for example, north, east and depth, or any other suitable coordinate system. The calculation steps can be implemented by a microcomputer system 70.

At step 67, the rod string is lowered and an additional rod is attached, thus advancing the accelerometers one rod length. When this happens, $a_2$, $b_2$, $c_2$ become $a_1$, $b_1$, $c_1$ for the next calculation. The process then repeats at steps 61*a*, 61*b*, 61*c* for the next step. It is important when attaching a new rod that the rods already in the hole remain fixed and are not twisted.

Another embodiment of the invention eliminates the need for Hookes-joint connections on the rods, and instead uses rods which may be secured together in a conventional way, as by screwing together. The rods are assumed to flex to accommodate curvature in the bore hole, but the rods are constructed to have isotropic grain so that they will not twist.

Figure 6:
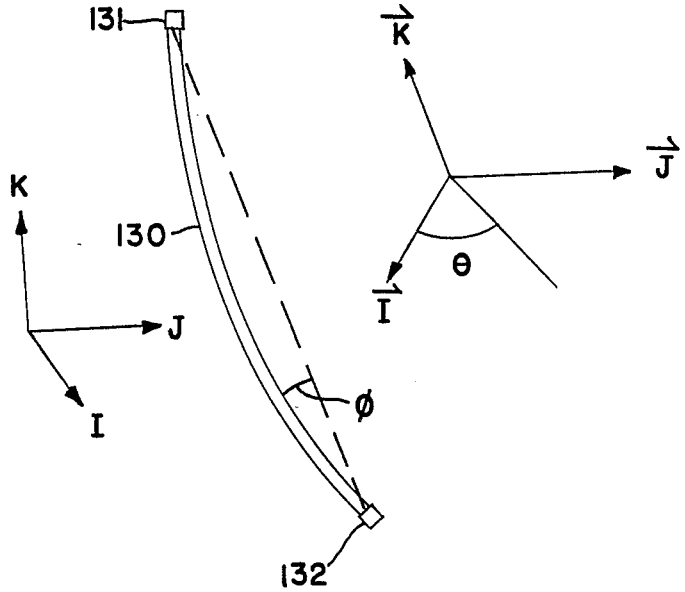
FIG. 6 is a diagram illustrating the coordinate system used for calculation of rod flexure according to an alternate embodiment of the invention.

This alternate embodiment follows the same general approach as in FIG. 1, except that the rods and techniques of joining the rods are different. In FIG. 6, a rod 130 is shown which would be used with this alternate embodiment. It has suitable end fittings 131, 132 which permit securing the rod to adjacent rods in the rod string. Any suitable type of fitting 131, 132 can be used, for example, screwing adjacent rods together. As previously mentioned, the rods are assumed to undergo twistless flexure, and the readings from the three accelerometers are used with modified computational algorithms to model the twistless rod flexure and enable calculation of the attitude and position of the instrument pod as each new rod length is added to the string.

The rod coordinate frame is also indicated in FIG. 6, and is defined in terms of I, J and K body axes. The K axis is upward along the rod length. Thus, assuming flexure, and no twist, each rod element rotates relative to its predecessor about some axis in the I-J plane. Let the axis of rotation be at some angle $\theta$ to the I-axis, as indicated in FIG 6. Then the rotation axis is represented by the unit vector:

$$u = I\cos\theta + J\sin\theta$$

Suppose that the rotation of the rod is $\phi$ as indicated in FIG. 6. The, the rotation is represented by the matrix M with the following elements:

$$m_{11} = \tfrac{1}{2}(1 + \cos\phi + \cos 2\theta(1 - \cos\phi))$$

$$m_{12} = m_{21} = \frac{\sin 2\theta}{2}(1 - \cos\phi)$$

$$m_{13} = \sin\theta\sin\phi$$

$$m_{31} = -m_{13}$$

$$m_{22} = \tfrac{1}{2}(1 + \cos\phi - \cos 2\theta(1 - \cos\phi))$$

$$m_{23} = -\cos\theta\sin\phi$$

$$m_{32} = -m_{23}$$

$$m_{33} = \cos\phi$$

The rotation m updates the attitude matrix, M, of the lead rod:

$$M = mM$$

Let the gravity vector be seen as:

$$\hat{k}_2 = a_2 I + b_2 J + c_2 K,$$

in the current lead rod attitude, and as:

$$\hat{k}_1 = a_1 I + b_1 J + c_1 K,$$

in the preceding lead rod attitude. Then, by definition:

$$\hat{k}_2 = \overline{m}\hat{k}_1,$$

where overbars denote transpose. This leads to the three equations:

$$a_2 = \frac{a_1}{2}(1 + \cos\phi + \cos 2\theta(1 - \cos\phi)) + \frac{b_1}{2}\sin 2\theta(1 - \cos\phi) - c_1\sin\theta\sin\phi$$

$$b_2 = \frac{a_1}{2}\sin 2\theta(1 - \cos\phi) + \frac{b_1}{2}(1 + \cos\phi - \cos 2\theta(1 - \cos\phi)) + c_1\cos\theta\sin\phi$$

$$c_2 = a_1\sin\theta\sin\phi - b_1\cos\theta\sin\phi + c_1\cos\phi$$

These can be manipulated to yield:

$$a_2\cos\theta + b_2\sin\theta = a_1\cos\theta + b_1\sin\theta$$

$$a_2\sin\theta - b_2\cos\theta = \cos\phi(a_1\sin\theta - b_1\cos\theta) - c_1\sin\phi$$

$$c_2 = c_1\cos\phi + \sin\phi(a_1\sin\theta - b_1\cos\theta)$$

These can be solved for $\theta$ and $\phi$ to give:

$$\theta = \arctan\frac{(a_2 - a_1)}{b_1 - b_2}$$

For convenience, select the principle value solution $(-90° \leqq \theta \leqq +90°)$ $$\phi = \arctan\frac{(a_1\sin\theta - b_1\cos\theta)}{c_1} - \arctan\frac{(a_2\sin\theta - b_2\cos\theta)}{c_2}$$

For $\phi$, select those pair of values which give small $\phi$, rather than $\phi = 180°$. From $\phi$ and $\theta$, the matrix m is computed, and the end-rod attitude matrix is updated:

$$M = mM$$

Ideally, with zero computing noise, the third row of M should exactly equal the gravity vector, as seen in the accelerometers. If not, we can "square up" at M at each update, to make this so, and also keep M orthonormal by applying the same procedure described above for the first embodiment.

After squaring, and with the new value of M, the navigation update is simply:

$$\vec{R} = \vec{R} - \vec{k}l$$

where:

$\vec{R}$ = Position vector
$l$ = Rod length
$\vec{k}$ = Unit vector along lead-rod
= $M_3$ (third column of lead-rod attitude matrix)

In this embodiment also, the computations are done in real-time on-line, using a microcomputer to process each new set of accelerometer readings, at each rod addition.

The only limitation on this technique is when the bore hole becomes horizontal. The $\phi$ calculation gets "noisy", and finally blows up when $c_1$ or $c_2 = 0$ (perfect horizontality).

An alternative simplified algorithm may be used, based on the fact that $\phi$ will, in practice, be a very small angle. With this, the evaluation of m reduces to the simple form:

$$m = \begin{bmatrix} 1 & 0 & (a_1 - a_2)/c_1 \\ 0 & 1 & (b_1 - b_2)/c_1 \\ \dfrac{(a_2 - a_1)}{c_1} & \dfrac{(b_2 - b_1)}{c_1} & 1 \end{bmatrix}$$

Using this simplified approach, we take the accelerometer readings, difference the a and b components from the previous readings, compute m as shown above, and use it to update M and thence get a new value k, and so update $\vec{R}$.

In either technique, the calculation and updating of the R vector provides an accurate survey of the bore hole at all depths, and this information can be stored, displayed or printed out as may be appropriate for the intended use of the survey data, in accordance with known data handling techniques.

Thus, it will be appreciated from the foregoing description that the present invention provides improved apparatus and methods for simple and accurate bore hole surveys.

What is claimed is:

1. Bore hole survey apparatus, comprising:

an instrumentation pod adapted for travel down a bore hole to be surveyed;

said pod including accelerometer means for sensing the Earth's gravity vector with respect to a frame of reference of the pod;

a plurality of rods, including means for attachment of said pod to one of said rods and means for interconnecting said rods to form a rod string for lowering said pod into said bore hole, said rods configured to permit limited motions thereof with respect to adjacent rods in response to turns or curves in the bore hole as the rod string is lowered;

said rod string being a continuous length of rods from the surface of the Earth to said pod; and computation means connected for receiving signals from said accelerometer means and responsive to said signals and to the incremental rod-by-rod lowering of said pod into said bore hole for calculating the attitude and updated position of said pod based on successive accelerometer readings and mathematically modeled motions of the rods in following curves in the bore hole as the pod is lowered in the bore hole.

2. Bore hole survey apparatus according to claim 1 wherein said attachment means for said rods includes Hookes-joint attachments at the ends of the rods, permitting two degrees of freedom of movement between the adjacent rods.

3. Bore hole survey apparatus according to claim 1 wherein said rod interconnection means includes means for rigidly securing adjacent rods together and wherein said rods are isotropic for twistless flexure as the rod follows curves in the bore hole, and wherein said computational means is adapted to calculate pod position based upon twistless flexure of said rods.

4. Bore hole survey apparatus according to claim 1 wherein said accelerometer means comprises three accelerometers positioned within said pod with their sensitive axes along three mutually perpendicular directions.

5. Bore hole survey apparatus according to claim 4 wherein the sensitive axis of one of said accelerometers is aligned with the longitudinal axis of said pod along which it travels down the bore hole.

6. Bore hole survey apparatus according to claim 1 wherein said instrumentation pod is formed integrally with the first rod in the rod string.

7. A method of surveying a bore hole, comprising the steps of:

inserting an instrumentation pod containing accelerometer means into the bore hole to be surveyed;

connecting a plurality of rods to form a continuous rod string with the pod adjacent to the lead end thereof;

lowering the instrumentation pod and the rod string into the bore hole, the rods being configured to permit limited motions thereof with respect to adjacent rods in response to turns or curves encountered as the pod and rod string is lowered in the bore hole;

sensing the Earth's gravity vector by said accelerometer means for successive incremental steps of lowering of the pod; and calculating the attitude and updated position of said pod based on successive accelerometer readings and mathematically modeled motions of the rods in following curves in the bore hole as the pod is lowered.

8. The method according to claim 7 wherein said step of lowering said pod comprises lowering by successive steps corresponding to the lengths of said rods as the rods are added to the rod string, and wherein said step of sensing the Earth's gravity vector is done corresponding to each rod-length of lowering.

9. The method of claim 7 further including the step of initializing the pod prior to lowering in the bore hole by aligning the sensitive axes of the accelerometer means with predetermined directions at the surface.

* * * * *